US006505732B1

(12) United States Patent
Meinke et al.

(10) Patent No.: US 6,505,732 B1
(45) Date of Patent: Jan. 14, 2003

(54) APPARATUS FOR TRANSPORTING FOLDING PACKAGE MATERIAL FORMS IN THE TOBACCO-PROCESSING INDUSTRY

(75) Inventors: Karsten Meinke, Hamburg (DE); Jürgen Grossmann, Wentorf (DE); Frank Bley, Hamburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 75 days.

(21) Appl. No.: 09/663,442

(22) Filed: Sep. 15, 2000

(30) Foreign Application Priority Data

Sep. 18, 1999 (DE) ..... 199 44 812

(51) Int. Cl.[7] ..... B65G 29/00

(52) U.S. Cl. ..... 198/470.1; 198/803.1; 53/225; 53/234; 493/243; 493/402

(58) Field of Search ..... 198/470.1, 803.1; 53/225, 234; 493/167, 243, 247, 402

(56) References Cited

U.S. PATENT DOCUMENTS 4,084,393 A * 4/1978 Focke ..... 53/137
4,548,019 A * 10/1985 Kruse ..... 53/170
4,730,442 A * 3/1988 Focke et al. ..... 53/579
4,843,798 A 7/1989 Focke et al.
5,261,209 A * 11/1993 Focke et al. ..... 53/410

FOREIGN PATENT DOCUMENTS

| | | |
|---|---|---|
| DE | 24 40 006 C 2 | 6/1984 |
| DE | 35 22 614 A 1 | 1/1987 |
| DE | 39 41 844 A 1 | 6/1991 |
| DE | 197 03 069 A 1 | 7/1998 |

* cited by examiner

*Primary Examiner*—Khoi H. Tran
(74) *Attorney, Agent, or Firm*—Venable; Robert Kinberg; Chad C. Anderson

(57) ABSTRACT

An apparatus for transporting folding packaging material forms in the tobacco-processing industry, particularly carton forms for cigarette hard packs that have been scored or pre-punched along fold lines, from a feed station to a processing station. A rotary table is mounted for rotation about an essentially vertical axis. The rotary table includes at least one receiving platform having oppositely located lateral holders defining limits for the packaging material. At least one of the lateral holders is movable from a feeding position into a holding position relative to the oppositely-located lateral holder.

6 Claims, 3 Drawing Sheets

APPARATUS FOR TRANSPORTING FOLDING PACKAGE MATERIAL FORMS IN THE TOBACCO-PROCESSING INDUSTRY

BACKGROUND OF THE INVENTION

The invention relates to an apparatus for transporting folding package material forms in the tobacco-processing industry, particularly carton forms for cigarette hard packs that have been scored or pre-punched along fold lines, from a feed station to a processing station by means of a rotary table.

An apparatus of this type, disclosed in DE-OS 19 703 069, is typically integrated into a work process and for encasing block-shaped groups of cigarettes to produce so-called hinged-lid packages. The package material forms prepared in this manner are guided to a foil-encased block of cigarettes with a flat, horizontal orientation, so they can be positioned relative to the cigarette groups for successive packaging operations.

The stage-wise rotational movement of the rotary table, which involves acceleration and deceleration phases, can lead to misalignments, particularly vertical misalignments, or buckling of surface regions of the package material forms, which are already weakened in their inherent rigidity due to notching and scoring. These problems can impede the packaging process.

SUMMARY OF THE INVENTION

It is an object of the invention to implement the transport process and the positioning of the package material forms more reliably.

In accordance with the invention, this object is accomplished in that the rotary table, which rotates about an essentially vertical axis, is provided with at least one receiving platform that is limited by lateral holders, with at least one lateral holder being movable out of a feeding position into a holding position, relative to a respective oppositely-located lateral holder.

Within the scope of the invention, it is conceivable to provide a lateral holder that moves with linear guidance relative to the stationary lateral holder. A preferred modification according to the invention, however, provides that the feeding and holding positions are respectively defined by open or closed pivoting positions of the lateral holders.

According to a further proposal, the package material form can be securely held if the pivotable lateral holder is provided with a retaining groove having a run-in slant.

According to a further modification, the secure gripping and positioning is further supported by the provision of a plurality of superposed retaining notches for the stationary lateral holder that cooperates with the movable lateral holder.

In a double platform formed by two receiving platforms, the respective inside, stationary lateral holders cooperate with outside, movable lateral holders.

To utilize existing processing elements, it is further proposed that the movable lateral holder be connected to a base holder that pivots about a stationary axis.

The advantage attained with the invention is that the defined lateral holding of the forms allows them to be reliably transported, bound together, into the horizontal position. In the feed station, a greater tolerance range due to the open position of the lateral holder facilitates the deposit of the forms onto the rotary table, and in the processing station, the secure capture and orientation of the forms with respect to the stationary lateral holder assures their exact positioning relative to a block of cigarettes to be combined with the form.

BRIEF DESCRIPTION OF THE DRAWINGS

The invention is described in detail below by way of an embodiment illustrated in the drawing.

DETAILED DESCRIPTION OF THE INVENTION

Figure 1:
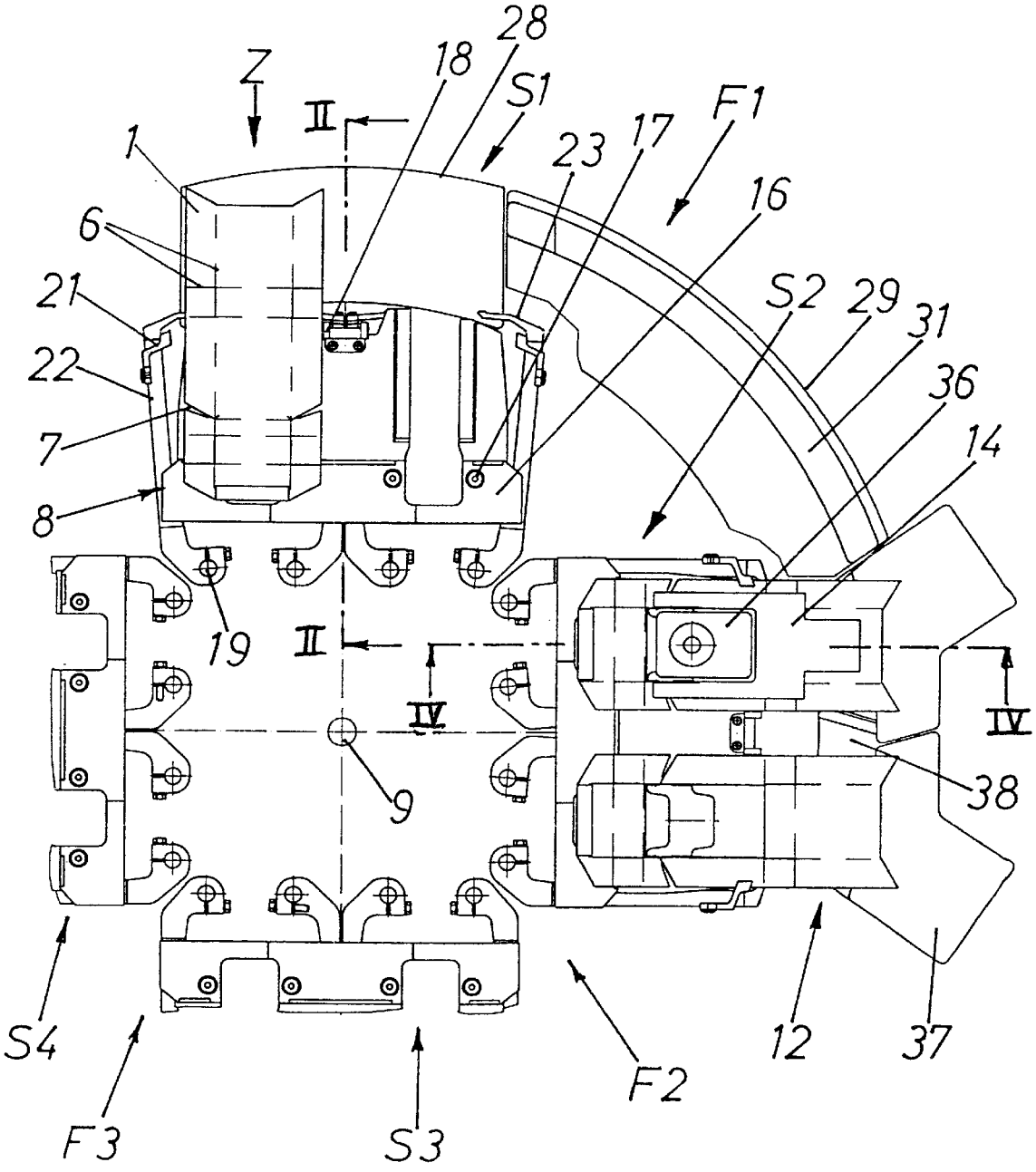
FIG. 1 is a partial plan view of transport elements of a dual-track packaging device for cigarettes.
Figure 4:
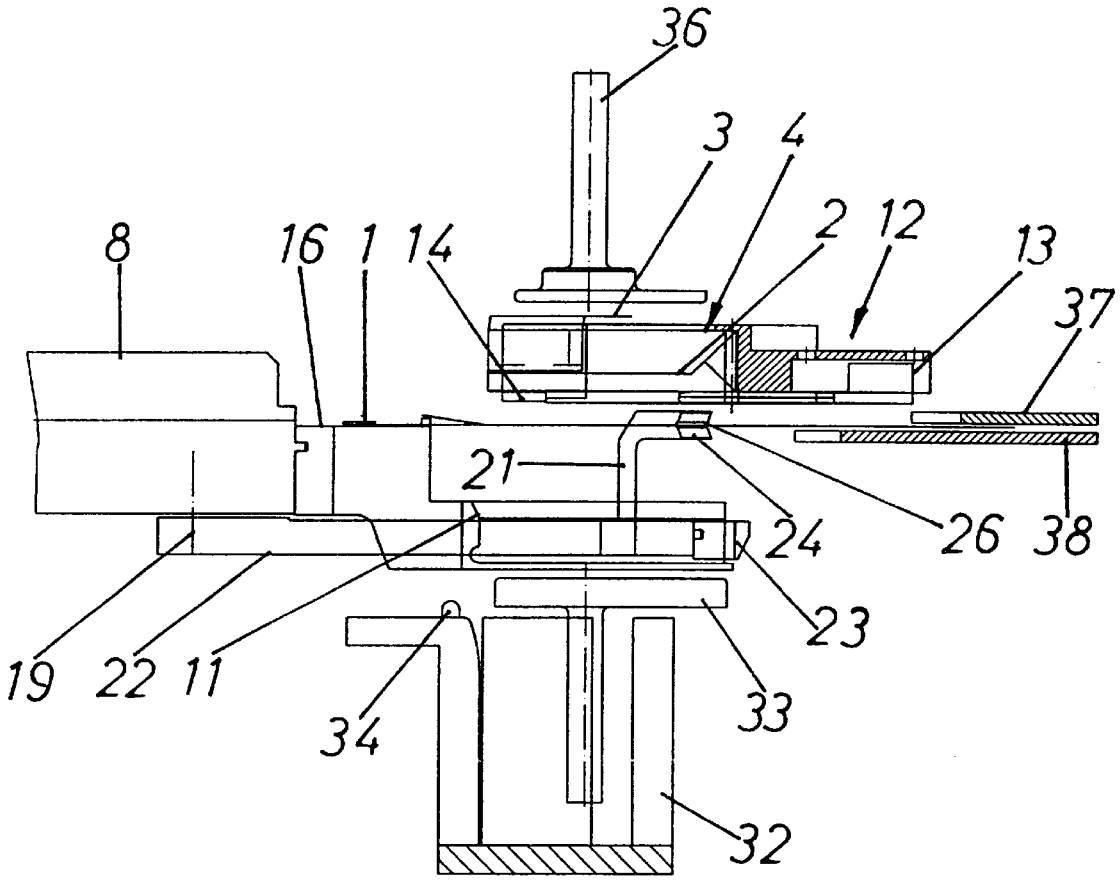
FIG. 4 is a partial section through the transport apparatus in a first processing station, along the line IV—IV according to FIG. 1.

Referring to FIG. 1, a package material form 1, also referred to as a blanket, serves as a hinged-lid package for encasing a block-shaped group 4 of cigarettes, which, according to FIG. 4, is provided with an inside wrapping foil 2 and an overlaid collar 3. The package material form 1 is provided with a plurality of scored fold lines 6 and stamped perforation lines 7, which correspondingly reduce its inherent rigidity.

Figure 2:
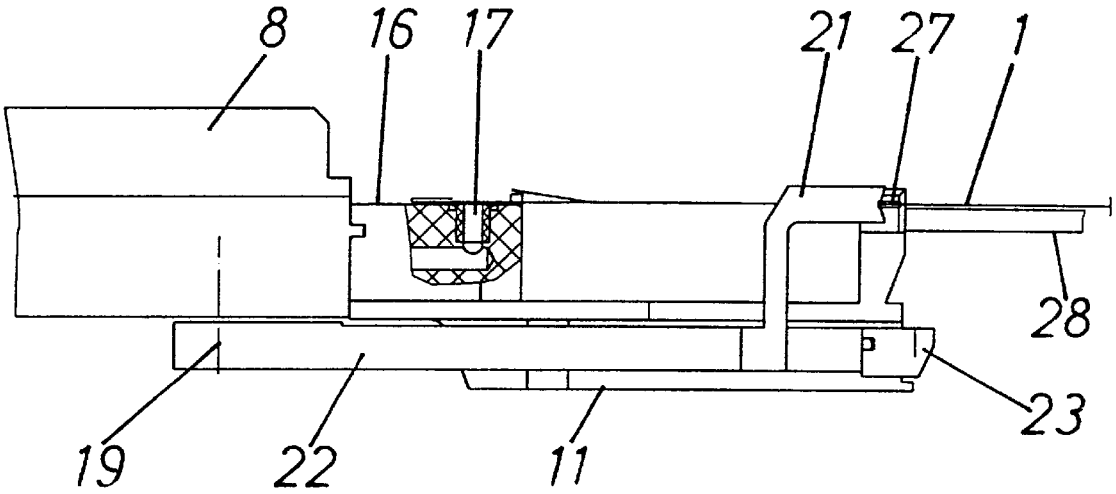
FIG. 2 is a side view, partly in section, of the transport apparatus along the line II—II according to FIG. 1.

The apparatus for handling such package material forms 1 for the purpose of guiding them to the cigarette groups 4 to be packaged has a conveyor element in the form of a lower rotary table 8, which can be driven to rotate step-wise about a vertical axis 9, and has four double arrangements of receiving pockets 11 according to FIGS. 2 and 4. According to FIGS. 1 and 4, the rotary table 8 cooperates with a conveyor element in the form of an upper rotary table 12, which partially overlaps the lower rotary table 8 and likewise has receiving pockets 14, which are arranged in pairs and can be blocked by support bars 13. The table can also be driven to rotate about a vertical axis.

Corresponding to the respective stopped positions of the rotary table 8 are a first station in the form of a feed station S1, a second station in the form of a joining and folding station S2, a third station in the form of a second folding station S3, not shown in detail, and a fourth station in the form of a feed station S4, also not shown in detail, the stations being connected to one another by conveyor segments F1 through F3. For the present invention, the conveyor segment F1 is of particular importance for transporting the package material forms 1 from the feed station S1 to the first folding station S2.

For this purpose, the rotary table 8 is provided in the vicinity of and above the receiving pockets 11 with receiving platforms 16 for the package material forms 1, with ventilation openings 17 terminating into the pockets for fixing the forms. Moreover, for the purpose of securing the forms 1 in their position as the table rotates, each receiving platform 16 is allocated stationary, inside lateral holders 18 and outside lateral holders 21, which can be rotated about axes 19. The lateral holders 21 are secured to pivoting levers 22, which are additionally equipped at their free ends with base holders 23.

Figure 3:
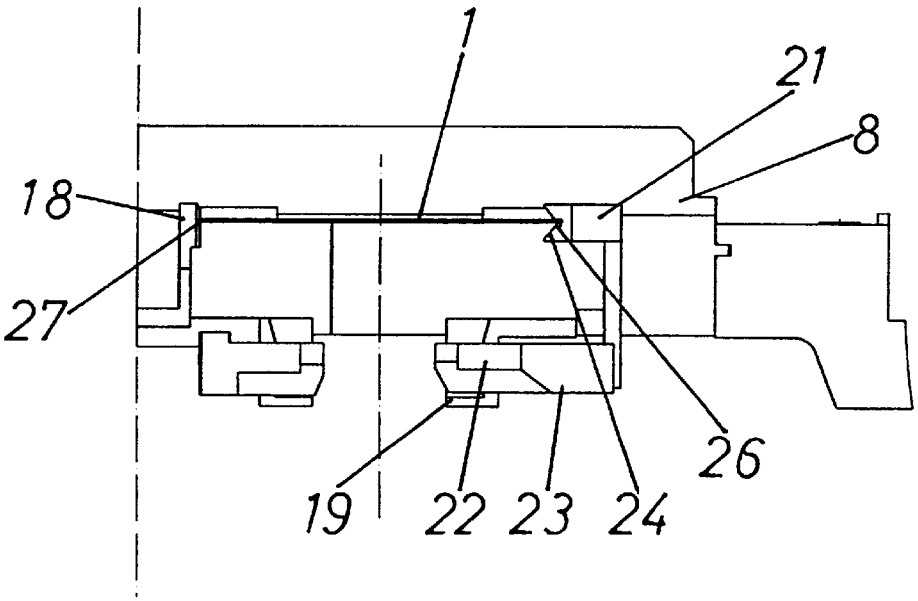
FIG. 3 is a front view of the transport apparatus in the direction of the arrow Z according to FIG. 1.

The outside, pivotable lateral holders 21 are provided with a retaining groove 26 that has a run-in slant 24, and the inside lateral holders 18 are provided with a plurality of superposed retaining notches 27 for the package material forms 1 (see FIG. 3) The retaining groove 26 and the retaining notches 27 of the lateral holders 21 and 18, respectively, are essentially located opposite one another in their working position, so as to generate as little torque as possible when the package material forms 1 are taken up.

Furthermore, stationary guides 28 and 29, 31 extend in the region of the feed station S1, and over the conveyor segment F1 between the feed station Si and the folding station S2, for the purpose of stabilizing the form 1 during pivoting. In the region of the first folding station F2, the underside of the lower rotary table 8 and the overlapping rotary table 12 is allocated an outside folding plunger 32 and an inside lower plunger 33, respectively, which can move, together or relative to one another, through the plane of the receiving platform 16 or the receiving pockets 11 of the lower rotary table 8. The folding plunger 32 is provided with upper latches 34. An upper plunger 36 that can be lowered with opposing timing or synchronously is associated with the lower plunger 33.

Moreover, auxiliary guides 37 and 38 that are superposed with slight spacing are provided for the forms 1 at the folding station S2, the guides being synchronized with the lowering movement of the folding and lower plungers 32, 33.

The operation of transporting the package forms 1 from the feed station S1 to the folding station S2 is as follows:

According to FIG. 1, the outside, movable lateral holders 21 assume an outside pivoting position in the feed station S1. The package material forms 1 are transported in a manner that is not shown, e.g., pushed radially inward or vertically deposited onto the receiving platform 16, more or less exactly between the sufficiently-spaced lateral holders. The forms 1 are fixed by the suction air applied at the suction openings 17, and gripped by the inward-pivoting lateral holders 21 at their retaining groove 26, then moved toward the stationary lateral holders 18, caught by their retaining notches 27, fixed and oriented exactly.

In this way, during the subsequent conveying step on the conveyor segment F1 from the feed station S1 to the folding station S2, accelerations and decelerations occurring there are prevented from misaligning the package material forms 1, or laterally or radially displacing them, or vertically buckling them. Thus, in the folding station F2, the package material forms 1 are positioned exactly, relative to the other cigarette groups 4 transported there, so packaging operations can be carried out there in the manner known from DE-OS 197 03 069.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. In an apparatus for transporting folding packaging material forms in the tobacco-processing industry, particularly carton forms for cigarette hard packs that have been scored or pre-punched along fold lines, from a feed station to a processing station, the improvement comprising:

a rotary table mounted for rotation about an essentially vertical axis, the rotary table including at least one receiving platform having oppositely located lateral holders defining limits for the packaging material, at least one of the lateral holders being movable from a feeding position into a holding position relative to the oppositely-located lateral holder, wherein the oppositely located holder is a stationary lateral holder.

2. The apparatus according to claim 1, wherein the feeding and holding positions are defined by open and closed pivoting positions, respectively, of the at least one lateral holder that is movable.

3. The apparatus according to claim 2, wherein the pivotable lateral holder includes a retaining groove that has a run-in slant.

4. The apparatus according to claim 1, wherein the oppositely located holder cooperates with the movable lateral holder and is provided with a plurality of superposed retaining notches.

5. The apparatus according to claim 1, wherein the at least one receiving platform includes two receiving platforms forming a double platform, and inside stationary lateral holders cooperate with outside, movable lateral holders.

6. The apparatus according to claim 5, further including a base holder connected to the movable lateral holder and pivotable about a stationary axis.

* * * * *